United States Patent [19]

Sanvito et al.

[11] 3,946,639

[45] Mar. 30, 1976

[54] FIN AND SPIN STABILIZED ROCKET

[75] Inventors: Francis A. Sanvito; Allen L. Pearson, both of Florissant, Mo.

[73] Assignee: Emerson Electric Co., St. Louis, Mo.

[22] Filed: Sept. 6, 1974

[21] Appl. No.: 503,637

[52] U.S. Cl. ..... 89/1.808; 89/1.816

[51] Int. Cl.[2] ..... F41F 3/00

[58] Field of Search ..... 89/1.808, 1.816, 1.819; 244/3.23, 3.24

[56] References Cited

UNITED STATES PATENTS

| | | | |
|---|---|---|---|
| 2,998,754 | 9/1961 | Bialy | 89/1.816 |
| 3,610,096 | 10/1971 | Bauman | 89/1.808 |
| 3,754,726 | 8/1973 | Rusbach | 89/1.816 |
| 3,857,320 | 12/1974 | Conard | 89/1.808 |

*Primary Examiner*—Verlin R. Pendegrass
*Attorney, Agent, or Firm*—Polster and Polster

[57] ABSTRACT

A weapon system is provided with a projectile incorporating improvements which reduce launching errors. In the preferred embodiment, the projectile is a rocket. The rocket is spin stabilized by gyroscopic force and a condition of nearly neutral aerodynamic stability is provided by the external rocket contour. In the preferred embodiment, the rocket is spin stabilized in flight by a forward fin ring and a rearward aerodynamic, flared skirt. The skirt includes a bearing ring structure which supports the rocket within a launcher vehicle or tube along the rearward portion of the rocket body. The fin ring constitutes a second projectile support during launch and is positioned along the forward portion of the projectile body. The projectile and its associated launcher vehicle are configured to eliminate tip off error. Both the bearing ring structure and fin ring are journaled to the projectile to permit rotation of the projectile body. The fin and bearing rings each have means integrally formed with them for spring loading the projectile within its launch vehicle prior to launch. Spring loading the projectile reduces mal aim launch errors during projectile firing.

21 Claims, 7 Drawing Figures

FIN AND SPIN STABILIZED ROCKET

BACKGROUND OF THE INVENTION

This invention relates to means for reducing launch errors in weapon systems. While the invention is discussed with particular reference to a rocket projectile and its associated launcher tube, those skilled in the art will recognize the wider applicability of the invention to other projectile and launcher vehicle systems.

Unguided projectiles of the prior art for use in air-to-air, air-to-ground, ground-to-ground or ground-to-air modes, generally have been deficient in delivery accuracy. One solution to the delivery accuracy problem is disclosed in the Bauman et al U.S. Pat. No. 3,610,096, issued Oct. 5, 1971. While the prior art in general, and the Bauman et al patent in particular, work well for its intended purpose, at least two error sources affecting the flight of a projectile heretofore have been unresolved.

In order to optimize the accuracy of fin and spin stabilized projectiles, the primary error sources, which include tip off, mal launch, and mal aim errors, must be minimized. The spin and fin stabilized projectile described in the above-referenced Bauman et al U.S. Pat., No. 3,610,096, works well to eliminate tip off error. The structure disclosed in Bauman et al, however, does not prevent the occurrence of mal launch and mal aim errors. Reference may be made to the Bauman et al U.S. Pat., No. 3,610,096, for constructional features not forming a portion of the invention disclosed herein. The invention described hereinafter is compatible with the Bauman invention, and is an improvement of the system there described. Features disclosed in Bauman et al, U.S. Pat. No. 3,610,096 not described herein are intended to be incorporated by reference.

Mal aim error is a term of art having reference to the fact that the center line of the projectile may be directed at some point other than the center line of the launcher vehicle. That is, projectile flight error can arise because of the manufacturing tolerances required in the construction of the projectile and an associated launcher. These tolerances often are sufficient to permit some clearance between a portion of the projectile supports or the projectile itself and the projectile launcher. In effect, the projectile becomes disaligned with respect to the centerline axis of the launcher. Since it is convenient to align any launch platform sight system with the launcher centerline axis, weapon systems have an uncompensated error built into them. Even when extremely close manufacturing tolerances are kept, with resulting increased product cost, the launcher and the projectile often are constructed of dissimilar materials. Consequently, the thermal expansion of the material varies, and again permits the undesirable disalignment between the projectile's centerline and the centerline of the launcher tube.

Mal launch also is a term of art, and broadly refers to errors that may arise from a number of sources. Primarily, this error is a result of the noncoincidence of the projectile's spin axis, which corresponds to the centerline between the centers of the bearings on which a spin stabilized projectile rotates, and the principal axis of the mass of the projectile. Spin stabilization, in itself, is intended to provide some compensation for any nonsymmetrical distribution of the projectile's mass. However, spin stabilization induces mal launch errors when the spin axis and mass axis do not coincide. While the maintanence of extremely high tolerances during projectile manufacture can lessen this error, the degree of accuracy required is such as to be prohibitive commercially.

The invention disclosed hereinafter minimizes these difficulties by providing a projectile having self-contained supports, which supports include integrally formed springs. Upon insertion in a launcher vehicle, the springs isolate the projectile body from the launcher vehicle, and insure that the supports always are in direct contact with the launcher vehicle. Consequently, the projectile body is given some degree of freedom within the launcher vehicle to permit the alignment of the spin and mass axes during projectile spin up but prior to launch while the integral supports necessarily maintain the projectile aligned along the launcher vehicle centerline axis. The forward projectile support preferably takes the form of a journaled aerodynamic fin ring, having a plurality of fins extending radially outwardly from a central hub. The fins contain an open-mouth channel along the distal fin end. The channel has first and second widths with the smaller width portion forming the mouth of the channel and opening through an edge of each of the fin plurality. The channel permits that portion of the fin outboard of the channel to function spring fashion, and the width of the channel mouth is controlled closely so as to limit the possible deflection of the outboard fin portion. The spring rate of the outboard portion of the fin may be controlled by selection of the widths and the lengths of the channel portions. The rearward projectile support is a bearing ring structure forming a part of a flared, aerodynamic skirt and includes a pair of spaced annular members joined by a thin skinned metal membrane. The bearing ring structure functions as a second projectile support during launch, and is frustum shaped in side elevation. The effective I.D. of that portion of the launcher vehicle in which the rearward projectile body part rests is slightly smaller than the effective O.D. of the bearing ring structure. This permits the thin skinned membrane to function as a flexible diaphragm which allows a hoop spring attached to one end of the membrane to stress. The hoop spring thus is able to exert a radial spring force between the projectile and the launch vehicle after projectile insertion. Clearance between the round and the launch tube is thus eliminated, and the round has a predetermined degree of radial freedom within the launcher to permit it to align its spin axis with the principal axis of its mass. Since the projectile is in contact with the launch tube until it is in free flight, and because the mass axis and the spin axis are allowed to coincide, accuracy of the weapons system is improved appreciably.

One of the objects of this invention is to provide a spin and fin stabilized weapon system having improved firing accuracy.

Another object of this invention is to provide a projectile body having integral support means for supporting the projectile in a launcher vehicle, the support means being capable of spring loading the projectile radially in the vehicle.

Another object of this invention is to provide a projectile body having an integrally formed forward support comprising a plurality of aerodynamic fins, individual ones of said fins having spring means integrally formed therein.

Yet another object of this invention is to provide a projectile having a bearing ring mounted along a rearward portion of said projectile, said bearing ring having spring means integrally formed therein.

Other objects will become apparent to those skilled in the art in light of the following description and accompanying drawings.

SUMMARY OF THE INVENTION

In accordance with this invention, generally stated, a weapon system is provided having improved projectile delivery accuracy. The system includes a tip off control launcher vehicle having first and second internal diameters. A projectile carried in the launcher includes integral forward and rearward support means. The forward support means preferably is a plurality of fins which support the projectile in the launcher prior to launch. The rearward support means includes a bearing ring structure designed as a part of a flared, aerodynamic skirt. The forward and rearward support means are designed to exert a radially directed spring force between the projectile and the launcher vehicle.

DESCRIPTION OF THE PREFERRED EMBODIMENT

Figure 1:
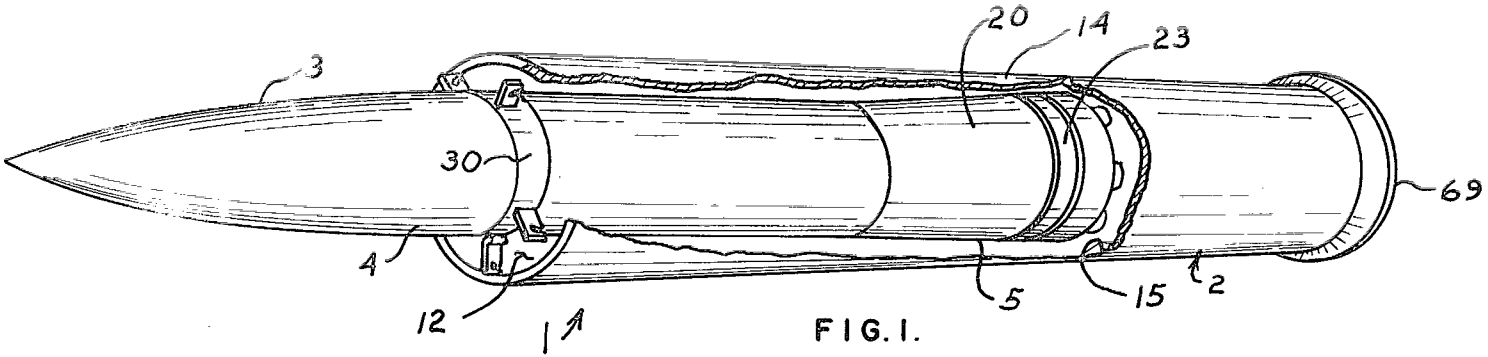
FIG. 1 is a view in perspective of one illustrative embodiment of weapon system of this invention.

Referring now to FIG. 1, reference numeral 1 indicates a rocket projectile 1 within a launcher vehicle 2, which combination constitutes the preferred embodiment of the invention. The projectile 1 includes an elongate body 3 having a forward portion 4 and a rearward portion 5. In general, the forward portion carries a warhead and fuse, not shown, of conventional construction, and the rearward portion carries a propulsion means, generally indicated by the numeral 6 in FIG. 3. The propulsion means 6 comprises a rocket boost propellant grain 7, and an exhaust nozzle 8 terminated in a rearward opening 9. Means 10 for rotating the projectile 1 about a longitudinal axis 11 is positioned about the rearward opening 9 of the portion 5. The projectile 1 is supported in the launcher 2 by front and rear support means corresponding to a fin ring 30 and a skirt 20 which includes an aft bearing ring structure 23. The fin ring 30 and skirt 20 also serve to stabilize the projectile 1 aerodynamically during flight, as will be later described in greater detail.

Figure 2:
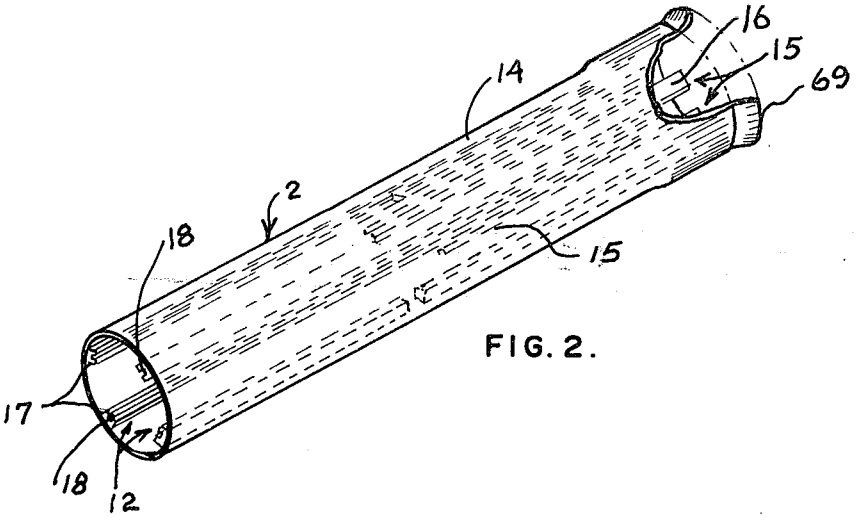
FIG. 2 is a view in perspective of a second embodiment of a launcher vehicle compatible with the weapon system of this invention.

The launcher vehicle 2, in the preferred embodiment, is an open-ended, thin walled, cylindrical tube 14 having a plurality of supports 15 spaced about its inner periphery. The supports 15 extend from near one end of the tube to near the center of the tube. Each of the supports 15 generally is rectangular in plan, and has a smooth surface 16 which abuts the projectile 1 along the skirt 20, and more specifically along the aft bearing ring structure 23 prior to launch. A forward part 12 of the tube 14 may assume either of two configurations, respectively illustrated in FIGS. 1 and 2. In FIG. 1, the part 12 of the tube 14 has a smooth, continuous wall running from the inboard end of the supports 15 to the forward end of the tube 14. In FIG. 2, however, the forward part 12 of the tube 14 has a plurality of rails 17 projecting radially inwardly from the internal perimeter of the tube. Like the supports 15, the rails 17 also are rectangular in plan. However, the rails 17 differ in that each rail 17 has a groove 18 in it which is utilized to engage projectile 1 along the outer boundary part of the fin ring 30, as later described in detail.

The supports 15 effectively decrease the internal diameter of the launch tube 14 throughout the extent of the supports. The supports 15, the relative dimension of the launch tube 14, and the dimensions of the projectile 1 are determined so as to eliminate tip off during launch. That is, the distance denominated $D_1$ in FIG. 3, between the rear edge of the forward projectile support, that is, the fin ring 30, and the forward or left hand end, referenced to FIG. 3 of the tube 14, is equal to the distance, denominated as $D_2$, between the rearward edge of the rearward projectile support, that is, the bearing ring structure 23 of the skirt 20, and the forward edge of the supports 15. In addition, the radial extent or height of the supports 15 is chosen so as to provide sufficient clearance to prevent projectile 1 contact with the forward part 12 of the launch vehicle 2 after the rearward projectile support clears the support 15, regardless of whether the forward part 12 of the launch tube 14 is smooth bored or includes a plurality of the rails 17. This clearance, or the difference between the internal fore and aft diameters of the launch tube, is such as to avoid contact under substantially all launch conditions and is sufficient to prevent projectile and launch tube intereference under normal application operating conditions or environment.

As indicated above, tip off control launchers are old in the art. Our invention differs specifically from and is an improvement over the prior art, for example, as disclosed in Bauman et al, U.S. Pat. No. 3,610,096, and the references cited therein, in the design of the projectile 1. The forward portion 4 of the projectile 1 is an aerodynamically streamlined configuration adapted to contain any associated warhead and fuse. The rearward body portion 5 of the projectile 1 comprises a propulsion motor case and insulation 19. The motor case also houses the propulsion means 6. The projectile 1 is supported within its associated launcher vehicle 2 prior to firing along the forward and rearward projectile supports fin ring 30 and skirt 20, respectively.

The skirt 20 is of a flared, aerodynamically design joined to the rearward body portion 5 of the projectile 1 by any convenient method. The skirt 20 includes an outwardly extending flared portion 21 and a longitudinally extending portion 22. The aft bearing ring 23 forms a part of the longitudinally extending portion 22. The aft bearing ring structure 23 in fact is that portion of the skirt 20 that functions as the rear projectile support for the projectile during launch. As indicated, the skirt 20 is configured so that the aft bearing ring structure 23 becomes a part of the skirt 20 design, even though in actuality, the ring structure 23 is manufactured as a separate unit and integrated into the skirt 20 composition during projectile 1 construction.

Ring structure 23 is journaled for rotation with respect to projectile 1 along a bearing 24. Bearing 24 is conventional and may comprise any convenient structure. In general, bearing rings suitable for use with the device of this invention include concentrically arranged inner and outer races 50 and 51 respectively, having a plurality of roller bearings mounted for rotation therebetween.

The aft bearing ring structure 32 includes a housing 53 which forms a frustum in side elevation. Housing 53 is defined by a forward retaining flange 25, a bearing insertion area 26, an isolating diaphragm 27, and a hoop spring 28.

A forward external diameter 60 of the bearing ring structure 23 is smaller than an aft external diameter 61. The housing 53 is canted outwardly, along the isolating diaphragm 27, to achieve its frustum shape. The diameter 61 represents the radially outermost portion of both the bearing ring structure 23 and the rear portion 5 of the projectile 1.

The flange 25 functions in part to locate the bearing 24, the races of which may be placed within the housing 53 so as to abut the flange 25. The bearing 24 and housing 53 may be joined to one another by any convenient method. Epoxy adhesive works well, for example. When epoxy adhesive is utilized, it is desirable, if not mandatory, to include a cement groove 29 along the bearing insertion area 26. The groove 29 insures that sufficient adhesive is present to bond the bearing 24 with the housing 53.

Figure 7:
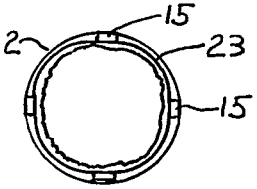
FIG. 7 is a diagrammatic sectional view illustrating the operation of the second projectile support during launch.
Figure 5:
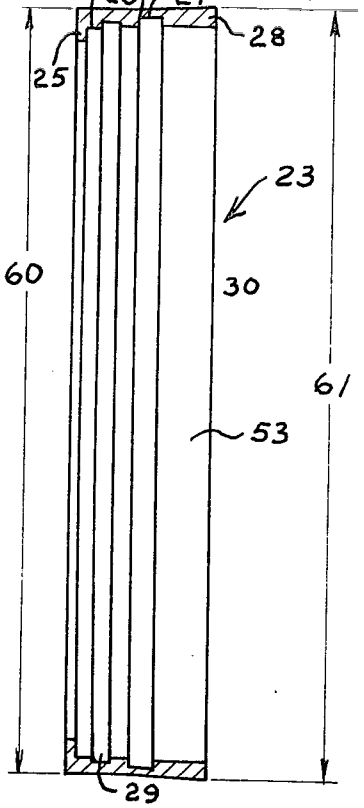
FIG. 5 is an enlarged view of an aft bearing ring structure constituting a second projectile support during launch.

The diametrically opposed ends of the ring 23 may be considered as cylindrical sections joined together by a thin conical skin or isolation diaphragm 27. That portion of the housing 53 forward of the diaphragm 27 is designed to be substantially inflexible in normal use. The inflexibility results from a number of factors. For example, the forward portion of the housing 53 has a relatively long axial dimension as compared to the axial dimension of hoop spring 28. In addition, the insertion of bearing 24 within the housing 53 substantially increases the radial depth of the forward portion. Isolating diaphragm 27, on the other hand, is a relatively thin, flexible portion of the housing 53. The spring 28 is joined to the bearing insertion area 26 by the diaphragm 27. The isolation diaphragm 27 permits the supports 15 of the tube 14 to deflect the hoop spring 28 upon insertion of the projectile 1 within the launcher 2. That is, that portion of the hoop spring 28, in contact with supports 15, is free to deflect radially inwardly. While a portion of the spring 28 deflects inwardly, that portion of the spring 28 between the supports 15 bows outwardly. This relationship is dramatically illustrated in FIG. 7. The spring 28 may continue to deflect until the bearing insertion area 26 comes into contact with the support 15. Since the area 22 is relatively inflexible, this contact acts as a positive stop limiting further deflection of either hoop spring 28 or the ring structure 23. The particular geometry of the hoop spring 28 and the isolating diaphragm 27 may be changed, in various embodiments of this invention to adjust the spring rate of the hoop spring.

Figure 3:
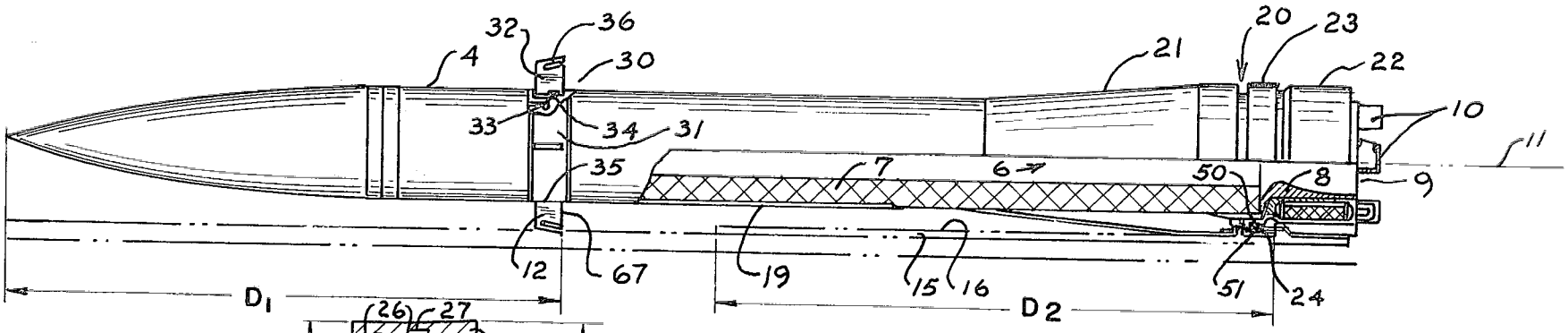
FIG. 3 is a view in side elevation, partly in section and partly broken away, of the weapon system shown in FIG. 1.
Figure 6:
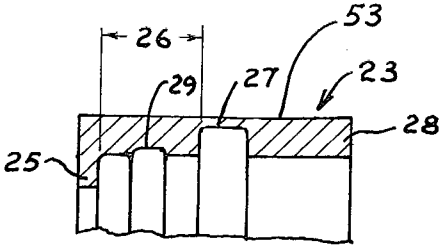
FIG. 6 is an enlarged view, partly broken away, and partly in section, of the second projectile support shown in FIG. 5.

As may be observed in FIG. 3, the bearing ring structure 23 is designed as a portion of the skirt 20. That is, the skirt 20 and bearing ring 23 form an integral design which is important in the aerodynamic characteristics of the projectile 1 after launch. That design is smooth flowing along the skirt portion 20.

The fin ring 30, as indicated above, comprises the other projectile support for the projectile 1. The ring 30 is similar to the fin ring disclosed in the above referenced Bauman et al U.S. Pat., No. 3,610,096, in that the fin ring 30 includes a ring or band 31 having four fins 32 extending radially outwardly from it. The fins 32 are spaced at approximately 90° intervals about the outer surface of the ring 30. Other fin arrangements are compatible with the broader aspects of our invention and both the number and relative spacing of the fins 32 may be varied in other embodiments of the projectile 1. The ring 30 is journaled for relative rotation on the projectile 1 by means of a bearing assembly 33 interposed between the ring 30 and the body 3 of the projectile 1. Bearing assembly 23 is conventional and any of a number of commercially available bearing assemblies may be utilized. The fins 32 and the flared skirt 20 are aerodynamically configured to stabilize the projectile during flight.

Figure 4:
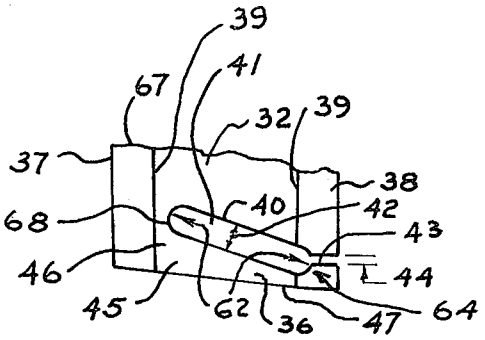
FIG. 4 is an enlarged view in side elevation, partly broken away, of a fin constituting a first projectile support during launch.

The use of a fin ring to stabilize a projectile in flight is a well known technique in the art. The ring 30 of this invention differs primarily in the construction of the individual fins 32. Each of the fins 32 has a body 67 having a proximal end 35 attached to the band 31, and a distal end 36 terminating the radially outward extension of the body 67 from the band 31. Each fin 32 also has a forward edge 37 and an aft edge 38. A broad face 46 extends between the edges 37 and 38 along each side of the material thickness of the fin 32. A radially outward tip 47 of the fin 32 is connected between the edges 37 and 38, as is best observed in FIG. 4.

It is conventional to strengthen the individual fins 32 by providing ridges 39 in the material forming the fins 32. Other strengthening techniques may be used, if desired. Each of the fins 32 has an open-mouthed groove 40 extending through its material thickness. The mouth of the groove 40 opens through the edge 38 of the fin 32. Groove 40 includes a first portion 41 having a first length dimension 62 and a first width dimension 42. A second portion 43 of the groove 40 has a second length dimension 64 and a second width dimension 44. The width dimension 42 of the portion 41 is substantially larger than the width dimension 44 of the portion 43, and the groove 40 is placed in the fin 32 so that the width dimension 44 defines the open mouth of the groove. That part of the fin body 67 outboard of the groove 40 is attached to the remaining fin body along a relatively thin bridge 68. The relationship of the groove 40 and bridge 68 enables that part of the fin body 67 outboard of the groove 40 to define a spring 45, the spring rate of which is controlled in part by the geometry of the groove 40. That is, the portion of the fin body 67 outboard of the groove 40 may move radially inwardly or outwardly in response to force applied to the tip 47. As indicated, tip 47 is canted slightly to facilitate the radial compression of the spring 45 when the projectile 1 is inserted in the tube 14. The deflection of the spring 45 radially inwardly is limited by the size of the width dimension 44 of the groove 40 in that closure of the open mouth of the groove 40 prevents further radial movement of the spring 45.

The weapon system of our invention may be utilized in air-to-air, ground-to-ground, and ground-to-air configurations, in either guided or unguided modes. In the air-to-ground configuration, the launcher vehicle 2 may be utilized both as a protective shipping container for the projectile 1, and as the launcher proper. The projectile is loaded from the backside of the tube 14, regardless of whether the tube 14 has the rails 17 attached to its forward portion. As observable in FIG. 2, the rails 17 are positioned off center with respect to the supports 15 so that the fins 32 pass the narrow internal diameter portion of the tube 14. The tube 14 may have a flared rim 69 formed in it to aid in projectile 1 insertion. Means, not shown, may be provided for locking the projectile within the launcher vehicle 2 after insertion. The outer effective diameter of the fin ring 30, determined by the fins 32, is chosen to be greater than the inner diameter of the forward portion of the tube 14 so that the spring 45 of each of the fins 32 is compressed slightly after the projectile insertion in the tube 14.

When it is desired to launch the projectile 1, a conventional electrically or mechanically ignited squib, not shown, is activated to ignite the rotating means 10. The tangentially directed thrust forces produced by the rotating means 10 cause the projectile 1 to rotate about its longitudinal axis 11, which corresponds to the imaginary centerline extending between the two projectile supports, fin ring 30 and bearing ring structure 23. Low friction spin support is provided at the forward end of the projectile 1 by the fin ring 30, where the fin ring 30 and the individual fins 32 remain stationary while the projectile body 3 rotates along the bearing assembly 33, and at the rearward end of the projectile 1 by the aft bearing structure 23 where the housing 53 remains stationary while the projectile body 3 rotates along the bearing 24. When the rails 17 are used, the tip 47 of the fin 32 is engaged by the groove 18 which insures that rotation between the fins 32 and the launcher vehicle 2 is prevented. Use of the rails 17 is preferred commercially because, in addition to preventing any fin movement, the rails give additional structural support to the relatively thin fin 32 design. However, an interference fit between the forward portion of the launcher vehicle 2 and the end 36 of the fins 32 may be utilized, if desired, and weapon systems utilizing this latter design have been tested successfully.

After the projectile 1 reaches its designated spin rate, the main motor propellant is electrically or mechanically ignited to accelerate the projectile in a longitudinal direction. Since the distance between the aft edge 38 of the fins 32 and the forward exit end of the launch tube 14 is equal to the distance between the rearward end of the hoop spring 28 and the forward end of the supports 15, fins 32 pass the forward end of the launcher tube 14 at the same instant in time that the rearward end of the bearing ring structure 33 passes the forward end of the supports 15, and moves into the larger internal diameter portion of the launcher tube 14. This condition is illustrated in FIG. 1. Thus, the projectile is in a free flight phase of launch while it is partially contained within the launcher tube 14. Since the fore and aft projectile supports simultaneously release from the launcher tube, and since the clearance of the forward section of the launch tube is sufficient to prevent projectile contact under substantially all launch conditions, tip-off errors normally associated with tube launched projectiles are eliminated.

Prior to launch, as the rocket is brought up to spin rate, it is able to shift against the pre-loaded springs 45 and 28 to align the mass axis of the projectile with its spin axis. Since the fins 32 and aft bearing ring structure 23 travel with the projectile 1, they maintain pressure against the launcher until the projectile 1 attains the free flight condition described above. Because the projectile 1 always is in contact with the launcher tube and because the projectile is permitted some radial freedom within the launch tube 14 which enables it to align its mass and spin axis, both mal aim and mal launch errors are reduced substantially. As with the Bauman et al projectile described in U.S. Pat. No. 3,610,096, the forward and rearward projectile supports during launch remained with and form a part of the aerodynamic design of the projectile. Consequently, improved accuracy is achieved, and the system is debris-free after firing.

Numerous variations, within the scope of the appended claims, will be apparent to those skilled in the art in light of the foregoing description and accompanying drawings. Thus, the design of the springs 28 and 45, may be varied. For example, the fin ring 30 and its associated bearing 33, may be spring loaded inboard of the assembly 33. This design is less advantageous in that the projectile 1 is somewhat less stable in the launcher vehicle 2. Likewise, the hoop spring 28 may be replaced with a more conventional assembly. It is believed that control of the spring rate is harder to achieve when more conventional spring constructions are used for spring loading the projectile 1 within the launcher vehicle 2. Some degree of variance in the design of body 3 of the projectile 1 is possible. For example, the flared part 21 of the skirt 20 may meet the body 5 at some point other than as shown. Likewise, the number of fins 32 or their relative location may be altered. These variations are merely illustrative.

Having thus described the invention, what is claimed and desired to be secured by Letters Patent is:

1. A projectile system, which comprises:

launcher means;

a fin and spin stabilized projectile carried by said launcher means, said projectile including:

an elongated cylindrical body having a forward portion and a rearward portion, said rearward portion including a flared, aerodynamic skirt having a larger circumference than said forward portion of said projectile, said skirt including a bearing ring structure forming a part of said skirt, said bearing ring structure defining an outermost diametric part of said skirt, and including means for permitting free rotation of said projectile along said bearing ring structure, the bearing ring structure portion of said skirt comprising a rearward support for said projectile during launch;

propulsion means carried by said rearward portion for propelling said projectile along a flight path to a target;

means, carried by said projectile for rotating said projectile about its longitudinal axis for spin stabilizing said projectile during flight; and a plurality of symmetrically arranged and rotationally free aerodynamic fin means carried by said projectile for guiding said projectile along a flight path to a target, said fin means comprising a second projectile support during launch, individual ones of said fin means plurality having an open mouth channel formed in it near the radially outward end of said fin means, said channel having a first width portion and a second, materially different width portion, the smallest of said first and second width portions forming the open mouth part of said channel.

2. The projectile system of claim 1 wherein said bearing ring structure comprises a housing including a bearing mounting area, a flexible diaphragm portion, and a hoop spring separated from said bearing mounting area by said diaphragm portion, said hoop being resiliently deflectable and defining said rearward support for said projectile during launch.

3. The projectile system of claim 2 wherein the housing of said bearing ring structure has silhouette shaped in plan as a frustum.

4. The projectile system of claim 3 wherein the outboard tip of individual ones of said fin plurality is canted so that the radially outermost part of individual ones of said fin means is near the open mouth part of said channel.

5. In a rocket system including a smooth bore, projectile bearing tube, a plurality of supports spaced about a periphery of and attached to said tube, said supports and said smooth bore tube defining first and second tube sections delineated by first and second internal diameters, and a projectile carried by said tube prior to launch, the improvement which comprises means for spring loading said projectile in said tube during prelaunch actuation of said projectile, said spring loading means comprising a first self-contained projectile support comprising a first support means journaled for rotation with respect to said projectile and attached thereto along a rearward portion of said projectile, said first support means including means for spring loading said projectile in said tube, and a second self-contained projectile support comprising a plurality of symmetrically arranged and rotationally free aerodynamic fins carried by said forward portion of said projectile, each of said fin plurality including means for spring loading said projectile in said tube, said projectile being adapted to be carried by said tube such that said first projectile support rests in said first tube internal diameter and said second projectile support rests in said second tube internal diameter.

6. The improvement of claim 5 wherein each of said fins has an open mouth channel formed in it near the radially outward end of said fin, said channel having a first width portion and a second width portion, the smallest of said first and said second width portions forming the open mouth portion of said channel, the portion of said fin outboard of said channel defining a spring, said spring comprising said means for spring loading said projectile in said tube for said fin plurality.

7. The improvement of claim 6 wherein said projectile includes an elongated cylindrical body having a forward portion and a rearward portion, said fin plurality being carried by said projectile along said forward portion, said rearward portion including a flared, aerodynamic skirt having a larger circumference than said forward portion of said projectile, said skirt including a bearing ring structure defining the outermost diametric portion of said skirt, said bearing ring structure permitting free rotation of said projectile and further constituting said first self-contained projectile support.

8. The improvement of claim 7 wherein said bearing ring structure comprises a housing including a bearing mounting area, a flexible diaphragm portion, and a hoop spring separated from said bearing mounting area by said diaphragm portion, said hoop spring being resiliently deflectable for spring loading said projectile in said tube along the rearward portion of said projectile body.

9. The improvement of claim 8 wherein the distance between the rearward ends of said fin plurality and the forward end of said tube is equal to the distance between the rearward end of said bearing ring structure and the forward end of said support plurality.

10. A combination fin and spin stabilized projectile and launcher therefor, which comprises:

an elongated projectile body having a forward portion and a rearward portion, said rearward portion including a first projectile support attached to said projectile and journaled with respect thereto so as to permit rotation of said projectile, said first projectile support including means for exerting a radial spring force between said projectile and a projectile bearing tube;

propulsion means carried by said projectile for propelling said projectile along a flight path to a target;

means for rotating said projectile about its longitudinal axis for spin stabilizing said projectile during flight;

a plurality of symmetrically arranged and rotationally free aerodynamic fin means carried by said projectile for guiding said projectile along a flight path to a target, said fin means comprising a second projectile support during launch, said fin means including means for exerting a radial spring force between said projectile and a projectile bearing tube;

an open ended projectile bearing tube; and at least two supports spaced about the inner periphery of said tube so as to define first and second tube sections delineated by first and second internal diameters and arranged so that said first projectile support rests in said first internal diameter and said second projectile support rests in said second internal diameter.

11. The combination of claim 10 wherein said fin means comprises a ring surrounding said projectile with four fins spaced 90° about said ring and extending radially outwardly therefrom, said ring being journaled to said body for relative rotation with respect thereto, each of said fins having a proximal end attached to said ring and a distal end extending radially outwardly therefrom, individual ones of said fin means having an open mouth channel formed in it near the radially outward end of said fin, said channel having a first width portion and a materially different second width portion, the smallest of said first and said second width portions forming the open mouth of said channel.

12. The combination of claim 11 wherein said first projectile support includes a bearing ring structure having a housing, said housing including a bearing mounting area, a flexible diaphragm portion, and a hoop spring separated from said bearing mounting area by said diaphragm portion, said hoop spring being resiliently deflectable so as to permit insertion of said projectile in said projectile bearing tube.

13. The combination as set forth in claim 12 wherein the internal diameter of said first and said second tube sections are less than the effective outer diameter of said first and said second projectile supports prior to insertion of said projectile in said tube.

14. The combination of claim 13 wherein the distance between the rearward edge of said fin means and the forward end of said tube is equal to the distance between the rearward end of said first projectile support and the forward end of said spaced supports.

15. In a weapons system including a launcher vehicle having a bore for receiving a projectile, said bore having first and second sections delineated by first and second internal diameters, and a projectile carried by said launcher vehicle prior to launch, the improvement which comprises means for spring loading said projectile in said bore so as to permit diametric movement by said projectile with respect to said bore, said spring loading means comprising a first self-contained projectile support for supporting said projectile along said supporting said projectile along said second bore section, each of said first and second supports including means for spring loading said projectile with respect to said launcher vehicle, said launcher vehicle and said projectile being supportingly isolated from one another except along said first and said second supports.

16. The improvement of claim 15 wherein said projectile includes an elongated body having a forward portion and a rearward portion, said rearward portion including a flared aerodynamic skirt and a bearing support structure forming a portion of said skirt, said bearing support structure defining said second projectile support.

17. The improvement of claim 16 wherein said bearing support structure includes a housing having a bearing mounting area, a flexible diaphragm portion and spring means separated from said bearing mounting area by said flexible diaphragm portion, said spring means being resiliently deflectable.

18. The improvement of claim 17 wherein the housing of said bearing support structure is shaped as a frustum in plan.

19. The improvement of claim 15 wherein said first projectile support comprises a plurality of symmetrically arranged, rotationally free aerodynamic fin means carried by said projectile for guiding said projectile along a flight path to a target, individual ones of said fin means plurality having an open mouth channel formed in them near their radially outward extremity, said channel having a first width portion and a substantially different second width portion, the smaller of said first and said second width portions forming the open mouth of said channel.

20. The improvement of claim 19 wherein the tip of each of said fin means is canted so that the radially outermost part of said fin means is near the open mouth part of said channel.

21. The improvement of claim 19 wherein the first section of said bore includes means for preventing angular rotation of said fin means, said rotation preventing means comprising a plurality of rails extending longitudinally of said bore.

* * * * *

UNITED STATES PATENT OFFICE

CERTIFICATE OF CORRECTION

Patent No. 3,946,639 Dated March 30, 1976

Inventor(s) Francis A. Sanvito and Allen L. Pearson

It is certified that error appears in the above-identified patent and that said Letters Patent are hereby corrected as shown below:

Column 11, line 11, before "supporting", add ---first bore section, and a second projectile support for---.

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*